US006203960B1

(12) United States Patent
Ciccarelli et al.

(10) Patent No.: US 6,203,960 B1
(45) Date of Patent: Mar. 20, 2001

(54) TONER COMPOSITIONS

(75) Inventors: Roger N. Ciccarelli, Rochester; Denise R. Bayley, Fairport; Thomas R. Pickering, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/643,244

(22) Filed: Aug. 22, 2000

(51) Int. Cl.[7] ..... G03G 9/097
(52) U.S. Cl. ..... 430/110; 399/252
(58) Field of Search ..... 430/110; 399/252

(56) References Cited

U.S. PATENT DOCUMENTS

| | | | | |
|---|---|---|---|---|
| 3,900,588 | | 8/1975 | Fisher | 430/125 |
| 4,395,485 | | 7/1983 | Kashiwagi et al. | 430/110 |
| 4,845,004 | | 7/1989 | Kobayashi | 430/110 |
| 4,973,540 | | 11/1990 | Machida et al. | 430/110 |
| 5,437,955 | | 8/1995 | Michlin | 430/110 |
| 5,914,210 | | 6/1999 | Demizu et al. | 430/110 |
| 5,989,768 | * | 11/1999 | Little | 430/110 |
| 6,004,714 | | 12/1999 | Ciccarelli et al. | 430/110 |
| 6,103,441 | * | 8/2000 | Tomita et al. | 430/110 |

* cited by examiner

*Primary Examiner*—Roland Martin
(74) *Attorney, Agent, or Firm*—John L. Haack

(57) ABSTRACT

A toner composition including a binder, colorant, and a toner particle surface additive component comprised of a fumed silica coated with a first major amount of an alkylsilane compound and a second minor amount of an aminoalkylsilane compound, wherein the fumed silica has a relatively large particle size of, for example, a primary particle size diameter determined by BET measurement of from about 25 to about 75 nanometers an aggregate particle size of from about 225 nanometers to about 400 nanometers.

A toner composition including a binder, colorant, and a toner particle surface additive component comprised of a mixture of first coated fumed silica coated with an alkylsilane compound and a second coated fumed silica coated with an aminoalkylsilane compound wherein the first and second fumed silicas each has the same relatively large particle size.

A toner composition including a binder, colorant, and a mixture of two distinct coated fumed silicas as surface additives wherein one silica is surface coated with an alkylsilane compound and the other silica is surface coated with an aminoalkylsilane compound and where the silica used for the alkylsilane coating is larger in size diameter than the silica used for the aminoalkylsilane coating.

35 Claims, No Drawings

TONER COMPOSITIONS

CROSS REFERENCE TO COPENDING APPLICATIONS AND RELATED PATENTS

Attention is directed to commonly owned and assigned U.S. Pat. No. 6,004,714, issued Dec. 21, 1999, to Ciccarelli, et al., entitled "Toner Compositions."

Attention is directed to commonly assigned copending applications: U.S. Ser. No. 09/132,623 filed Aug. 11, 1998, entitled "Toner Compositions", discloses a toner comprised of resin, colorant and a coated silica, and wherein the silica has a primary particle size of about 25 nanometers to about 55 nanometers and an aggregate size of about 225 nanometers to about 400 nanometers and a coating comprised of a mixture of an alkylsilane, and an aminoalkylsilane; and U.S. Ser. No. 09/132,185 filed Aug. 11, 1998, entitled "Toner Compositions", discloses a toner with a coated silica with, for example, certain BET characteristics. The disclosures of each the above mentioned patent(s) are incorporated herein by reference in their entirety. The appropriate components and processes of these patents may be selected for the toners and processes of the present invention in embodiments thereof.

The disclosures of each the above mentioned references are incorporated herein by reference in their entirety. The appropriate components and processes of these references may be selected for the toners and processes of the present invention in embodiments thereof.

BACKGROUND OF THE INVENTION

This invention relates generally to improved toner compositions. More specifically the present invention relates to toner compositions including an externally situated performance additive or additives comprised of one or more specifically surface treated fumed silica particulate materials. Fumed silicas are known ultrafine silicon dioxide particulate materials that can have a variety of surface coatings thereover, and which particles and the selection of the coatings thereover can have a profound influence upon the toner and developer properties and performance characteristics. The present invention provides improved examples of surface treated fumed silica particulate materials and which materials can be readily be prepared and provide superior and unexpected toner charging properties, improved imaging processes and imaging apparatuses, and extended lifetime of various imaging apparatus components, such as fuser rollers, and the like componentry utilizing the improved toner. The imaging processes of the present invention provide toners with high flow properties and stable $A_t$ properties that prevent or eliminate background deposits on the developed images, and effectively eliminate or minimize the detrimental so-called toner "charge through" phenomena. The imaging processes of the present invention provide working toners with an unimodal charge distribution, that is toners with little or no low charge or wrong sign toner as measured by a charge spectrograph. The imaging processes of the present invention provide toners that when fresh toner is dispensed into aged toner in a machine-throughput mode, little or no low charge or wrong sign toner is formed or remains in the working toner as measured by a charge spectrograph. The toner compositions of the present invention in embodiments thereof possess excellent admix characteristics, maintain their triboelectric charging characteristics for an extended number of imaging cycles, and enable the elimination or minimization of undesirable background deposits or spots on the imaging member or photoconductor, and the image receiver sheet or copy paper. Furthermore, the toner compositions of the present invention are substantially insensitive to relative humidity in a printing or copying machine environment and permit developed images with excellent optical densities and low background. Developers of the present invention are comprised of the toners and carrier particles, especially carrier particles comprised of a core with a mixture of polymers thereover. The toner and developer compositions of the present invention can be selected for electrophotographic imaging and printing processes, especially color processes and particularly digital processes.

The toner and developer compositions of the present invention can be selected for electrophotographic, especially xerographic, imaging and printing processes, including color, digital processes, and multicomponent systems apparatus and machines.

PRIOR ART

In U.S. Pat. No. 5,914,210, to Demizu et al., issued Jun. 22, 1999, there is disclosed a reversal development of an electrostatic latent image formed on a positively charged amorphous silicon type photoreceptor, with a developer including positively charged toner particles containing binder resin and a colorant, first inorganic fine particles having a number-average particle diameter of 0.1 to 3 microns, and second inorganic fine particles subjected to surface treatment by a hydrophobic agent and having an average primary particle diameter of 0.005 to 0.02 microns.

In U.S. Pat. No. 4,973,540, to Machida, et al., issued Nov. 27, 1990, there is disclosed a developer for developing electrostatic latent images formed on an electrostatic latent image carrier, which comprises a toner including: a resin, a colorant, and an inorganic fine particle with at least both a negatively chargeable polar group and a positively chargeable polar group on the surface of the inorganic fine particle.

In U.S. Pat. No. 4,845,004, to Kobayashi, issued Jul. 4, 1989, there is disclosed a hydrophobic silica-type micropowder comprising silica-type microparticles which have been treated with certain secondary or tertiary amine-functional silanes. When the micropowder is combined with a positively-charging resin powder, such as a toner, the fluidity of the resin powder is substantially increased and this improved fluidity is retained upon long term storage.

In U.S. Pat. No. 6,004,714, to Ciccarelli, et al., issued Dec. 21, 1999, there is disclosed a toner comprised of binder, colorant, and a silica containing a coating of an alkylsilane.

In U.S. Pat. No. 3,900,588, issued Aug. 19, 1975, to Fisher et al., there is disclosed an imaging technique and composition for developing electrostatographic latent images whereby a developer composition is employed comprising toner, a substantially smearless polymeric additive like KYNAR®, and an abrasive material surface additive such as silica, like AEROSIL R972®, or strontium titanate, see column 7, lines 12 to 17.

In U.S. Pat. No. 5,437,955, issued Aug. 1, 1995, to Michlin, there is disclosed a dry toner composition for electrophotography including a binder resin, a coloring agent and a mica-group mineral, which mineral provides the toner composition with lubricity and better flow capabilities. The mica-group mineral is wet ground and may be coated with calcium stearate to reduce static electricity generated during operation of the electrophotographic machine.

In U.S. Pat. No. 4,395,485, issued Jul. 26,1983, to Kashiwage, et al., there is disclosed a one component type dry developer for electrophotography which is improved on humidification, and consists of a mixture of toner with a particle size of about 5 to 50 microns and a hydrophobic flow agent. The flow agent is made by coating inorganic, organic, metallic or an alloy powder with a thin film of non-hydrophilic synthetic resin. A flow agent having non-hydrophilic and electrically conductive properties is obtained.

The aforementioned patents are incorporated in their entirety by reference herein.

Other patents of interest follow. Toners and developers with surface additives of metal salts of fatty acids like zinc stearate and silica are known, reference for example U.S. Pat. Nos. 3,983,045 and 3,590,000. The commonly owned and assigned U.S. Pat. No. 3,983,045, issued Sep. 28, 1976, to Jugle et al., discloses a developer composition comprising 1) electroscopic toner particles, 2) a friction-reducing material, such as fatty acids, metal salts of fatty acids, fatty alcohols, fluorocarbon compounds, polyethylene glycols, and the like, of a hardness less than the toner and having greater friction-reducing characteristics than the toner material, and 3) a finely divided non-smearable abrasive material, such as, colloidal silica, surface modified silica, titanium dioxide, and the like metal oxides, of a hardness greater than the friction-reducing and toner material. In U.S. Pat. No. 4,789,613, there is illustrated a toner with an effective amount of, for example, strontium titanate dispersed therein, such as from about 0.3 to about 50 weight percent. Also disclosed in the '613 patent is the importance of the dielectric material with a certain dielectric constant, such as strontium titanate, being dispersed in the toner and wherein the surface is free or substantially free of such materials. Further, this patent discloses the use of known charge controllers in the toner, see column 4, line 55, olefin polymer, see column 5, line 35, and a coloring agent like carbon black as a pigment. Treated silica powders for toners are illustrated in U.S. Pat. No. 5,306,588. Toners with waxes like polypropylene and polyethylene are, for example, illustrated in U.S. Pat. Nos. 5,292,609; 5,244,765; 4,997,739; 5,004,666 and 4,921,771. Magnetic toners with low molecular weight waxes and external additives of a first flow-aid like silica and metal oxide particles are illustrated in U.S. Pat. No. 4,758,493, the disclosure of which is totally incorporated herein by reference. Examples of metal oxide surface additives are illustrated in column 5, at line 63, and include strontium titanate. Single component magnetic toners with silane treated magnetites are illustrated in U.S. Pat. No. 5,278,018. In column 8 of the '018 patent, there is disclosed the addition of waxes to the toner and it is indicated that surface additives such as AEROSIL®, metal salts of fatty acids and the like can be selected for the toner. Magnetic image character recognition processes and toners with magnetites like MAPICO BLACK® are known, reference for example U.S. Pat. No. Re. 33,172, the disclosure of which is totally incorporated herein by reference, and U.S. Pat. No. 4,859,550. The 33,172 patent also discloses certain toners with AEROSIL® surface additives. The toners and developers of the present invention may in embodiments be selected for the MICR and xerographic imaging and printing processes as illustrated in the 33,172 patent. Moreover, toners with charge additives are known. Thus, for example, there is described in U.S. Pat. No. 3,893,935, the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchlorate, tetrafluoroborate, benzene sulfonate, and the like; U.S. Pat. No. 4,221,856, which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933, which is a division of U.S. Pat. No. 4,291,111; and similar teachings are presented in U.S. Pat. No. 4,291,112, wherein A is an anion including, for example, sulfate, sulfonate, nitrate, borate, chlorate, and the halogens. Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635, which illustrates a toner with a distearyl dimethyl ammonium methyl sulfate charge additive. Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There remains a need for toners and developer compositions with improved image quality and reduced image distortion and background deposits. There also remains a need for toners with, for example, superior flow, environmental stability, and charging properties, and imaging processes thereof, and which toners are substantially insensitive to relative humidity, possess excellent admix characteristics, stable $A_r$ properties, no evidence of background deposits when the toner is selected for the development of images after about 1 million imaging cycles, or when the toner is tested in an aging fixture for more than about 100 hours, and which toners are useful for the development of electrostatic latent images, or which toners can preferably be selected for MICR methods.

The aforementioned and other advantages are achievable with the toners and preparative and imaging processes of the present invention. The compositions and processes of the present invention are useful in many applications including printing, for example, particulate based ink jet and electrostatographic, such as in xerographic and ionographic, printers and copiers, including digital systems.

SUMMARY OF THE INVENTION

Embodiments of the present invention, include:

A toner composition including a binder, colorant, and a toner particle surface additive component comprised of a fumed silica coated with a first major amount of an alkylsilane compound and a second minor amount of an aminoalkylsilane compound, wherein the fumed silica has a relatively large particle size of, for example, a primary particle size diameter determined by BET measurement of from about 25 to about 75 nanometers an aggregate particle size of from about 225 nanometers to about 400 nanometers;

A toner composition including a binder, colorant, and a toner particle surface additive component comprised of a mixture of first coated fumed silica coated with an alkylsilane compound and a second coated fumed silica coated with an aminoalkylsilane compound wherein the first and second fumed silicas each has the same relatively large particle size;

A toner composition which incorporates a mixture of two distinct coated fumed silicas wherein one silica is surface coated with an alkylsilane compound and the other silica is surface coated with an aminoalkylsilane compound and where the size of the uncoated silica used for the alkylsilane coating is larger in diameter than the uncoated silica used for the aminoalkylsilane coating;

A toner composition including a first coated fumed silica coated with an alkylsilane compound and a second coated fumed silica coated with an aminoalkylsilane compound wherein the first and second coated fumed silica are mixed together such that the total silica present in the toner composition has a surface nitrogen content present on the surface of the fumed silica in an amount of from 3 to about 700 parts per million of nitrogen based on the total weight of the two fumed silicas;

Imaging processes which employ the above mentioned toner formulations as developers or as developers in combination with carrier particles wherein the toners exhibit, for example, a unimodal charge distribution, and little or no low charge or wrong sign toner as measured by a charge spectrograph;

Imaging processes which employ the above mentioned toner formulations as developers or as developers in combination with carrier particles wherein if fresh toner is dispensed into aged toner in a machine throughput mode, then little or no low charge or wrong sign toner is formed as measured by a charge spectrograph; and an Imaging apparatus which employ the above mentioned toner formulations as developers or as developers in combination with carrier particles in the above mentioned imaging processes wherein certain of the apparatus components which contact the toner formulation possess extended operational life-times, such as fuser rollers, and the like toner contact componentry.

These and other aspects are achieved, in embodiments, of the present invention as described and illustrated herein.

DETAILED DESCRIPTION OF THE INVENTION

The present invention in embodiments provides a toner composition comprised of binder, colorant, and a toner particle surface additive component comprised of a first coated fumed silica coated with a first major amount of an alkylsilane compound and a second minor amount of an aminoalkylsilane compound.

In embodiments the present invention provides toners which incorporate a surface treated or coated fumed silica component wherein the fumed silica particles are surface coated with an alkylsilane compound in a major amount and an aminoalkylsilane compound in a minor amount and where the uncoated silica has an average primary particle size diameter, for example, of from about 25 to about 75 nanometers.

In embodiments, the major amount of the alkylsilane coating compound can be present on the surface of the fumed silica in an amount of from about 3 to about 20 weight percent, and more preferably from about 6 to about 20 weight percent, based on the weight of the fumed silica. In embodiments, the minor amount of the aminoalkylsilane compound is present on the coated surface of the fumed silica in an amount of from about 3 to about 700 parts per million and more preferably from about 5 to about 500 parts per million, and most preferably about 10 to about 400 parts per million of basic or titratable surface nitrogen (N:) based on the weight of the fumed silica. In other embodiments, the minor amount of the aminoalkylsilane compound can be present on the fumed silica in an amount of from about 325 to about 375 parts per million, and more preferably from about 340 to about 360 parts per million of basic nitrogen based on the weight of the fumed silica.

Although not wanting to be limited by theory it is believed that only the portion of the nitrogen coating compound that is on the surface of the metal oxide particle or as part of the surface coating on the metal oxide particle which is accessible to acidic protons, that is, a N atom with a lone electron pair which can be titrated as measured by surface titration of the N:, is significant in achieving the toner properties and the accompanying benefits and advantages of the imaging apparatus and imaging processes of the present invention.

The alkyl group of the alkylsilane coating compound can contain, for example, from 3 to about 20 carbon atoms. In embodiments, the alkylsilane coating compound can be obtained from the reaction of a decyltrialkoxysilane compound, for example, the decyltrimethoxysilane or decyltriethoxysilane compound, with the fumed silica under anhydrous conditions. The alkoxy groups of the alkylsilane reactant compound can have for example, from 1 to about 10 carbon atoms, and preferably from 1 to about 4 carbon atoms, such as the methoxy, ethoxy, propoxy, butoxy, and the like derivatives.

The aminoalkylsilane coating compounds of the present invention, also known as coupling compounds because of the potentially reactive or associative functional groups at both ends of the molecule, can contain an alkyl group with from 2 to about 10 carbon atoms between the silicon atom and the nitrogen atom, for example, of the partial formula: $R_1R_2N—(CH_2)_n\text{-}Si\equiv$ where n is an integer from 2 to about 10, and wherein $R_1$ and $R_2$ can be a hydrogen, or an alkyl group with from 1 to about 5 carbon atoms which are linear or branched. As an example, the aminoalkylsilane coating compound can be obtained from the reaction of the fumed silica with a dialkylaminopropyltrialkoxysilane compound, for example, dimethylaminopropyltriethoxysilane, and related compounds. The aminoalkylsilane coating compound can also be obtained from the reaction of fumed silica with a gamma-aminopropyltrialkyloxysilane compound. In embodiments, the aminoalkylsilane can be a diaminoalkylsilane compound which contains a substituent, for example, of the formula $NH_2CH_2CH_2NHCH_2CH_2CH_2Si—O—$, which is covalently bonded or associated with the silica surface, or alternatively or additionally, as bonded to a second coating which is covalently bonded or associated with the silica surface, reference for example, the known example of a diamine bonded to silicone oil composition to form a modified oil composition, and the modified oil composition is in turn bonded to a particulate silica surface, and can include but need not be limited to, for example, the product of the reaction of the silica surface with an aminoethyl-aminopropyltrimethoxysilane compound. The term aminoalkylsilane can include mixtures of one or more aminoalkylsilane compounds with one or more diaminoalkylsilane compounds. The term aminoalkylsilane can also include, for example, aminosilane compounds or aminosilazane compounds.

In embodiments, the aminoalkylsilane compound can be a cyclic silazane, such as an alkylaminopropyldialkylsilazane which contains a substituent of the formula $\equiv Si—(CH_2)_3—NHCH_3$ and which substituent is believed to be introduced into or onto the silica surface with the coating in the coating process.

In embodiments, the minor amount of the aminoalkylsilane compound can be present on the fumed silica in an amount of from about 0.01 to about 1.0 weight percent based on the weight of the fumed silica.

In embodiments which employ a relatively large sized silica, the fumed silica can have a primary particle size diameter determined by BET measurement of from about 25 to about 75 nanometers and an aggregate particle size of from about 225 nanometers to about 400 nanometers.

In embodiments which employ a relatively small sized silica, the fumed silica can have a primary particle size diameter determined by BET measurement of from about 8 to about 25 nanometers and an aggregate particle size of from about 200 nanometers to about 275 nanometers.

The coated silica can be present in the toner composition in an amount of, for example, from about 1 to about 8 weight percent.

In the present invention toners can be formulated with a variety of known resin materials, including known polymeric materials and related materials. Preferable resins include but are not limited to, for example, styrene-acrylate copolymers, styrene methacrylate copolymers, styrene-butylacrylate copolymers, polyesters, and mixtures thereof. A preferred polyester is one that is formed from condensation of propoxylated bisphenol A and fumaric acid.

The toner compositions of the present invention can be characterized by various properties, for example, cohesivities of about 4 to about 40 percent, stable triboelectrical charge levels of from about 10 to about 50 microcoulombs per gram, a q/d of from about 0.2 to about 1.1 femtocoulombs per micron, and admix times of from about 1 to about 29 seconds.

In embodiments, the present invention provides developers that comprise, for example, mixtures of a carrier particles and one or more toners containing the surface additives disclosed herein. The developers of the present invention when used in known xerographic and related development apparatuses provide toners with a unimodal charge distribution as measured by a charge spectrograph. The developers of the present invention can employ uncoated or coated carrier core particles, an preferably polymer coated carriers. The developers with a polymer coated carrier and in combination with toners of the present invention provide toners which exhibit little or no low charge or wrong sign toner as measured by a charge spectrograph. In embodiments of the present invention the developers with a polymer coated carrier and a toner with the aforementioned surface treated additives can provide a developer wherein fresh toner when mixed with aged toner in a machine toner-throughput mode has little or no low charge or wrong sign toner as measured by a charge spectrograph.

The toners and developers of the present invention can further comprise minor amounts of other known additives including for example, toner charge additives, waxes, metal salts, or metal salts of fatty acids, and the like, and mixtures thereof. Minor amounts of toner additives can be in amounts of, for example, from about 0.01 weight percent to about 1 weight percent, and can include but are not limited to, for example, zinc stearate, and metal oxides including but not limited to, for example, titania ($TiO_2$), and titanic acids, and mixtures thereof.

Toners of the present invention can contain colorants and wherein the colorant is, for example, a pigment of cyan, magenta, yellow, black, red, green, blue, a dye, or mixtures thereof. The colorant can be present in an amount of, for example, from about 2 to about 30 weight percent based on the weight of the toner composition.

In embodiments the present invention provides toners which incorporate a mixture of two distinct coated fumed silicas wherein one silica is surface coated with an alkylsilane compound and the other silica is surface coated with an aminoalkylsilane compound and where the uncoated silicas are about the same size and have a relatively large average primary particle size diameter, for example, of from about 25 to about 75 nanometers. Thus the present invention provides a toner composition comprised of binder, colorant, and a toner particle surface additive component comprised of a mixture of first coated fumed silica present in the toner composition in an amount of from about 1 to about 8 weight percent which is coated with an alkylsilane compound in an amount of from about 3 to about 20 weight percent based on the weight of the first coated fumed silica, and a second coated fumed silica present in the toner composition in an amount of from about 0.05 to about 5 weight percent which is coated with an aminoalkylsilane compound in an amount of from about 1 to about 20 weight percent based on the weight of the second coated fumed silica, wherein the first and second fumed silicas each has a primary particle size diameter determined by BET measurement of from about 25 to about 75 nanometers an aggregate particle size of from about 225 nanometers to about 400 nanometers. In other embodiments there is provided a toner composition with first coated fumed silica coated with an alkylsilane compound and a second coated fumed silica coated with an aminoalkylsilane compound wherein the first and second coated fumed silica are mixed together such that the total silica present in the toner composition has a surface nitrogen content present on the surface of the fumed silica in an amount of from 5 to about 500 parts per million of nitrogen based on the total weight of the two fumed silicas.

The present invention in embodiments provides developers which include, for example, a polymer coated carrier and a toner containing the above mentioned surface additives. In embodiments, the polymer coated on the carrier is preferably a polyacrylate such as polymethylmethacrylate. In other embodiments the polymer coated on the carrier is preferably a mixture of polymers, such as a polyacrylate like polymethylmethacrylate and a polyester or polyurethane.

In embodiments the present invention provides toners which incorporate a mixture of two distinct coated fumed silicas wherein one silica is surface coated with an alkylsilane compound and the other silica is surface coated with an aminoalkylsilane compound and where the uncoated silica used for the alkylsilane coating is larger in size diameter than the uncoated silica used for the aminoalkylsilane coating. The larger average primary particle size diameter silica is, for example, of from about 25 to about 75 nanometers, and the smaller average primary particle size diameter silica is, for example, of from about to 8 about 25 nanometers. Thus the present invention provides in embodiments a toner composition comprised of binder, colorant, and a toner particle surface additive component comprised of a mixture of first coated fumed silica present in the toner composition in an amount of from about 1 to about 8 weight percent and which first silica is coated with an alkylsilane compound in an amount of from about 3 to about 20 weight percent based on the weight of the first coated fumed silica, and a second coated fumed silica present in the toner composition in an amount of from about 0.05 to about 5 weight percent and which second silica is coated with an aminoalkylsilane compound in an amount of from about 1 to about 20 weight percent based on the weight of the second coated fumed silica, wherein the first fumed silica has an uncoated primary particle size diameter determined by BET measurement of from about 25 to about 75 nanometers and an aggregate size diameter is about 225 to about 400 nanometers, and the second fumed silica is smaller and has an uncoated primary particle size diameter determined by BET measurement of from about 8 to about 25 nanometers and an aggregate size diameter is about 200 to about 275 nanometers.

In a preferred embodiment, in formulating toners containing silicas of the same or different size, the first and second coated fumed silica are mixed together so that the total silica present in the toner composition has a surface nitrogen content in an amount of from 3 to about 700 parts per million of basic nitrogen (N:) based on the total weight of the two fumed silicas, and more preferably from about 5 to about 500 parts per million of nitrogen based on the total weight of the two fumed silicas.

In another preferred embodiment, the first and second coated fumed silica can be mixed together so that the total silica present in the toner composition is from about 1 to about 8 weight percent.

In an embodiment of the present invention there is provided a toner composition comprised of binder, colorant, and a toner particle surface additive component comprised of a coated metal oxide which oxide is coated with a first major amount of an alkylsilane compound and a second minor amount of an aminoalkylsilane compound. The metal oxide can be, for example, a silica, a titania, an alumina, and the like metal oxides, mixed metal oxide composites, and physical mixtures thereof.

In another embodiment of the present invention there is provided a toner composition comprised of binder, colorant, and a toner particle surface additive component comprised of a first coated metal oxide coated with a first major amount of an alkylsilane compound and a second metal oxide which second oxide is either free of a surface additive or alternatively coated with a second minor amount of an aminoalkylsilane compound, reference for example, Example XVIII in the working examples.

The present invention provides in embodiments an imaging process including the development of an electrostatic image with the one or more of the above mentioned toners. Thus, for example in an exemplary process, a photoconductor can be charged, exposed with light to form an electrostatic image, followed by developing the electrostatic image with the toner, transferring the developed image to a substrate, fixing the image onto the substrate, and optionally cleaning or removing any residual toner from the photoconductor. The development step of imaging process of the present invention can be accomplished free of charge-through of refreshed toner. The imaging processes of the present invention provide toners with an unimodal charge distribution with little or no low charge or wrong sign toner as measured by a charge spectrograph. The imaging processes of the present invention provide working toners which when fresh toner is dispensed into aged toner in a machine operating in a machine-throughput mode produces little or no low charge or wrong sign toner is formed as measured by a charge spectrograph.

The present invention provides in embodiments an imaging apparatus comprising a photoreceptor, a developer housing for developing latent images on the photoreceptor, a receiver member for receiving the developed latent image from the photoreceptor, and a fuser roll for fixing the developed image on the receiver member, wherein the fuser roll-life is improved from about 100,000 prints to from about 500,000 prints compared to an imaging apparatus which develops a toner composition which is free of the fumed coated additives of the present invention. A known two-component developer apparatus can be employed for developing the toners of the present invention and which apparatus can include one or more magnetic brush rolls, a sump to contain the developer material, a means to add toner to the developer material in the sump, a means to mix the developer in the sump, a means to load the developer material onto the magnetic brush roll or rolls, and a means to supply biases to the magnetic brush roll. The present invention can be practiced with a known one-component developer apparatus and one or more of the toner disclosed and which apparatus comprises a donor roll, toner sump, a toner addition port to add toner to the sump, a mixer to mix the toner in the sump, a donor member loader to load toner onto a donor roll, a charger to charge the toner on the donor roll, and an electrical bias source and supply to provide a bias to the donor roll. The present invention can be practiced in a hybrid scavengeless developer apparatus containing a toner as illustrated herein, and which hybrid scavengeless developer apparatus comprises a donor roll, an electrical or magnetic bias to supply biases to the magnetic brush roll, the donor roll, and any electrodes present, and wherein by suitable spacing of the donor roll to photoconductor the toner moves from the donor roll to the image on the photoconductor, and wherein the movement of toner to the photoconductor is assisted by electrodes between the donor roll and photoconductor or electrodes in the donor roll.

Toner compositions with certain surface additives, including certain silicas, are known. Examples of these additives include colloidal silicas, such as certain AEROSILS like R972® available from DEGUSSA, metal salts and metal salts of fatty acids inclusive of zinc stearate, aluminum oxides, titanium dioxides, titanic acids, cerium oxides, and mixtures thereof, which additives are each generally present in an amount of from about 1 percent by weight to about 5 percent by weight, and preferably in an amount of from about 1 percent by weight to about 3 percent by weight. Several of the aforementioned additives are illustrated in U.S. Pat. Nos. 3,590,000 and 3,900,588, the disclosures of which are totally incorporated herein by reference. Also known are toners containing a mixture of hexamethyldisilazane (HMDS) and aminopropyltriethoxysilane (APTES).

Further, toner compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions. U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide, reference the Abstract of the Disclosure and column 3; and a similar teaching is presented in U.S. Pat. No. 4,312,933, which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986, 521 reversal developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, are developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007, 293; 4,079,014; 4,394,430; and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, there are illustrated toner compositions with chromium and cobalt complexes of azo dyes as negative charge enhancing additives. These and other charge enhancing additives, such as these illustrated in U.S. Pat. Nos. 5,304,449, 4,904,762, and 5,223,368, the disclosures of which are totally incorporated herein by reference, may be selected for the present invention in embodiments thereof.

Other features of the present invention include providing toner and developer compositions with a mixture of certain surface additives that enable acceptable high stable triboelectric charging characteristics from for example about 15 to about 55 microcoulombs per gram, and preferably from about 25 to about 40 microcoulombs per gram; toner and developer compositions with coated silica additives that enable humidity insensitivity, from about, for example, 20 to 80 weight percent relative humidity at temperatures of from about 60 to about 80° F. as determined in a relative humidity testing chamber; toner and developer compositions with a mixture of certain surface additives that enable negatively charged toner compositions with desirable admix properties of 1 second to about 60 seconds as determined by the charge spectrograph, and more preferably less than about 30 seconds; toner compositions with a mixture of certain surface additives that enable for example, low temperature fusing resulting in high quality black and or color images; and the formation of toners with a mixture of coated silica surface additives which will enable the development of images in electrophotographic imaging apparatuses, which images have substantially no background deposits thereon, are substantially smudge proof or smudge resistant, and therefore are of excellent resolution, and further, such toner compositions can be selected for high speed electrophotographic apparatuses, that is those exceeding about 60 copies per minute, and more specifically from about 60 to about 100 copies per minute.

In yet a further feature of the present invention there are provided humidity insensitive, from about, for example, 20 to 80 weight percent relative humidity at temperatures of from 60 to 80° F. as determined in a relative humidity testing chamber, positively charged toner compositions with desirable admix properties of about 5 seconds to about 60 seconds as determined by the charge spectrograph, and preferably less than about 30 seconds for example, and more preferably from about 1 to about 14 seconds, and acceptable high stable triboelectric charging characteristics of from about 20 to about 50 microcoulombs per gram.

Another feature of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

Aspects of the present invention are a toner comprised of resin, colorant and a coated silica, and wherein the silica has a primary particle size of about 25 nanometers to about 55 nanometers and an aggregate size of about 225 nanometers to about 400 nanometers, and the coating is comprised of a mixture of an alkylsilane and an aminoalkylsilane; a toner wherein the coating is generated from a mixture of about 10 weight percent to 25 weight percent of an alkylalkoxysilane and about 0.05 weight percent to about 1.0 weight percent of an aminoalkylalkoxysilane; a toner wherein the toner further contains surface additives of metal oxides, metal salts, metal salts of fatty acids, or mixtures thereof; a toner wherein the toner further contains surface additives of titania, metal salts of fatty acids, or mixtures thereof; a toner wherein the resin is polyester; a toner wherein the resin is a polyester formed by condensation of propoxylated bisphenol A and a dicarboxylic acid; a toner wherein the resin is comprised of a mixture of a polyester formed by condensation of propoxylated bisphenol A and fumaric acid, and a gelled polyester formed by condensation of propoxylated bisphenol A and fumaric acid; and a toner wherein the colorant is, for example, carbon black, cyan, magenta, yellow, red, orange, green, violet, or mixtures thereof.

Although not wanting to be limited by theory it is believed that the silane coating on the coated silicas is a polymer. The toner may also include optional additional known surface additives such as certain uncoated or coated metal oxides, such as titania particles present for example in various suitable amounts, like from about 0.50 weight percent to about 10 weight percent, and preferably from about 1.5 weight percent to about 4 weight percent of titania which has been coated with a feed input of from about 5 weight percent to about 15 weight percent a decyltrialkoxysilane. In addition, the toner may also include further optional surface additives such as a conductivity aides such as metal salts of fatty acids, like zinc stearate in an amount of, for example, from about 0.05 weight percent to about 0.60 weight percent.

The coating can be generated from an alkylalkoxysilane and an aminoalkylalkoxysilane as illustrated herein, and more specifically, from a reaction mixture of a silica like silicon dioxide core and an alkylalkoxysilane compound, such as decyltrimethoxy silane, and an aminoalkylalkoxy silane, such as aminopropylalkoxysilane. There results from the reaction mixture the coating contained on the silica core, and optionally containing residual alkoxy groups, and/or hydroxy groups. Preferably, in embodiments the coating is a mixture of the alkylsilane and aminoalkylsilane polymeric coating that contains crosslinking, reference for example the copending U.S. Ser. No. 09/132,623.

The toner compositions of the present invention can be prepared by admixing and heating resin particles such as styrene polymers, polyesters, and similar thermoplastic resins, colorant wax, especially low molecular weight waxes, and charge enhancing additives, or mixtures of charge additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, the coated silica and other additives are added by the blending thereof with the toner obtained. Illustrative examples of suitable toner binders, include toner resins, especially polyesters, thermoplastic resins, polyolefins, styrene acrylates, such as PSB-2700 obtained from Hercules-Sanyo Inc., and preferably selected in the amount of about 57 weight percent, styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol or a bis-phenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers, may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, reactive extruded resin, especially reactive extruded polyesters with crosslinking as illustrated in U.S. Pat. No. 5,352,556, the disclosure of which is totally incorporated herein by reference, styrene acrylates, and mixtures thereof. Also, waxes with a molecular weight $M_w$ weight average molecular weight of from about 1,000 to about 20,000, such as polyethylene, polypropylene, and paraffin waxes, can be included in, or on the toner compositions as fuser roll release agents. The resin is present in a sufficient, but effective amount, for example from about 50 to about 90 weight percent.

Colorant includes pigment, dyes, mixtures thereof, mixtures of dyes, mixtures of pigments and the like present in suitable amounts such as from about 1 to about 20 and preferably from about 2 to about 10 weight percent. Colorant examples are carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. A particularly preferred magenta is P.R. 81:2. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. A particularly preferred cyan is P.B.15:3. Illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. A particularly preferred yellow is P.Y.17. Known dyes are also suitable colorants, such as red, blue, green, and the like.

Magnetites include a mixture of iron oxides ($FeO.Fe_2O_3$), including those commercially available as MAPICO BLACK™, and are present in the toner composition in various effective amounts, such as an amount of from about 10 weight percent by weight to about 75 weight percent by weight, and preferably in an amount of from about 30 weight percent by weight to about 55 weight percent by weight.

There can be included in the toner compositions of the present invention charge additives as indicated herein in various effective amounts, such as from about 1 to about 19, and preferably from about 1 to about 3 weight percent, and waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K.K., and the like. The commercially available polyethylenes selected have a molecular weight of from about 1,000 to about 1,500, while the commercially available polypropylenes utilized are believed to have a molecular weight of from about 4,000 to about 7,000. Many of the polyethylene and polypropylene compositions useful in the present invention are illustrated in British Patent No. 1,442,835, the disclosure of which is totally incorporated herein by reference. The wax is present in the toner composition of the present invention in various amounts, however, generally these waxes are present in the toner composition in an amount of from about 1 weight percent by weight to about 15 weight percent by weight, and preferably in an amount of from about 2 weight percent by weight to about 10 weight percent by weight. The toners of the present invention may also in embodiments thereof contain polymeric alcohols, such as UNILINS®, reference U.S. Pat. No. 4,883,736, the disclosure of which is totally incorporated herein by reference, and which UNILINS® are available from Petrolite Corporation.

Developers include the toners illustrated herein with the mixture of silicas on the surface and carrier particles. Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, for example from about 2 weight percent toner concentration to about 8 weight percent toner concentration. The carriers can include coatings thereon, such as those illustrated in the U.S. Pat. Nos. 4,937,166 and 4,935,326, and other known coatings. There can be selected a single coating polymer, or a mixture of polymers. Additionally, the polymer coating, or coatings may contain conductive components therein, such as carbon black in an amount, for example, of from about 10 to about 70 weight percent, and preferably from about 20 to about 50 weight percent. Specific examples of coatings are fluorocarbon polymers, acrylate polymers, methacrylate polymers, silicone polymers, and the like.

Imaging methods are also envisioned with the toners of the present invention, reference for example a number of the patents mentioned herein, and U.S. Pat. Nos. 4,585,884; 4,584,253; 4,563,408 and 4,265,990, the disclosures of which are totally incorporated herein by reference.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Preparation of Coated Silica

200 Milliliters of dry n-propanol solvent were placed in a three neck 500 milliliter round bottom flask, and the solvent was sparged with dry nitrogen to remove excess oxygen. A 10 milliliter aliquot of solvent was removed to a small 2 dram vial and set aside. A second 20 milliliter aliquot was also removed and placed in a scintillation vial. 15 grams of untreated hydrophilic $SiO_2$ silica Cab-O-Sil L90 available from Cabot Corp., with a primary particle size of 30 nanometers as measured by BET (after Brunauer, Emmett, and Teller), a standard known technical method that measures surface area, and with model assumptions there can be calculated, for example, the primary particle size, and an aggregate size of about 300 nanometers as measured by Brownian motion was added to the flask and mixed with a mechanical mixer until wetted. An inert atmosphere was maintained during this mixing. A few drops of diethylamine was added to the 10 milliliter aliquot of solvent and the resulting mixture was added to the 500 milliliter flask. The mixture was then stirred for approximately 1 hour. To the 20 milliliter aliquot of solvent was added 2.25 grams (15 weight percent based on the weight of 15 grams of $SiO_2$) of decyltrimethoxysilane and 0.06 gram (0.4 weight percent based on the weight of 15 grams of $SiO_2$) of aminopropyltriethoxysilane. This mixture was added to the 500 milliliter flask containing the $SiO_2$ after the 1 hour of the above pretreatment was completed. The mixture was heated with a heating mantle to reflux for approximately 5 hours with stirring and under the inert atmosphere and then allowed to cool to room temperature, about 25° C. The mixture then was transferred to a tear-drop shaped flask and the solvent removed with a roto-evaporator under heat and vacuum. The flask was transferred to a vacuum oven and the drying completed over about 18 hours under full vacuum and moderate heating of about 40° C. The resulting decylsilane and aminopropylsilane treated silica was crushed with a mortar and pestle, and found to have a primary particle size of 30 nanometers as measured by BET and an aggregate size of about 300 nanometers as measured by Brownian motion.

EXAMPLE II

Preparation of Coated Silica

Thirty grams of an untreated hydrophilic $SiO_2$ silica powder core with a primary particle size of 40 nanometers and an aggregate size of about 300 nanometers were placed in a Büchi 2 liter autoclave reactor, and the reactor was sealed. Argon was purged for 30 minutes. The reactor was then evacuated using a vacuum pump while warming to 28° C. The vacuum valve was then closed and an ampoule of triethylamine was connected to the reactor such that the vapor space of the ampoule and the upper portion of the reactor are connected, thereby allowing the vapor phase transport of triethylamine to the bed of silica for about 15 minutes. The valve from the ampoule to the reactor was then closed and the valve to the vacuum reopened to remove excess triethylamine that was not physisorbed to the surface of silica. The reactor was then cooled to 0° C. with the aid of a Laude circulating bath connected to the reactor jacket. After achieving a temperature of 0° C., 570 grams of carbon dioxide (bone-dry grade obtained from Praxair) were then added to the chilled reactor with the assistance of an ISCO Model 260D motorized syringe pump. Agitation of the reactor was then initiated at 10 rpm. Next about 4.5 grams or about 15 weight percent based on the weight of 30 grams of $SiO_2$ of decyltrimethoxysilane from Shin-Etsu Silicones, and 0.12 grams, or about 0.4 weight percent based on the weight of 30 grams of $SiO_2$ of aminopropyltrimethoxysilane from PCR Research Chemicals were then dissolved in separate variable volume pressure cell using carbon dioxide as the solvent. The pressure in the cell was 100 bar which was sufficient to generate a homogeneous solution of the two silanes in carbon dioxide. The decyltrimethoxysilane solution was then injected into the Büchi 2 liter reactor. This injection procedure was then repeated with the 0.12 gram of aminopropyltriethoxysilane. After the injection of aminopropyltriethoxysilane, the temperature of the reactor was maintained at 0° C. and agitated at 100 rpm for 30 minutes. The agitation was then stopped and the carbon dioxide vented off from the upper portion of the reactor, that is the vapor or head space. After depressurization the reactor temperature was increased to about 28 to about 30° C. After equilibration at this temperature, the resulting decylsilane/aminopropylsilane treated or coated silica product was removed for vacuum treatment (about 18 hours, 150° C. for three hours) and then spectroscopically characterized with infrared spectroscopy.

EXAMPLES III-A, III-B, III-C, III-D, III-E, III-F, III-G

The procedure of Examples I and II were repeated except that 0.15 weight percent, 0.25%, 0.5%, 0.75%, 1.0%, 3.0%, and 5.0% aminopropyltriethoxysilane were used in place of 0.4% aminopropyltriethoxysilane.

EXAMPLES IV-A, IV-B, IV-C, IV-D, IV-E

The procedure of Examples I and II were repeated except that 0.025 weight percent, 0.05%, 0.25%, 0.5%, and 0.75% dimethylaminopropyltriethoxysilane were used in place of 0.4% aminopropyltriethoxysilane.

EXAMPLES V-A, V-B, V-C, V-D

The procedure of Examples I and II were repeated except that 0.1 weight percent, 0.2%, 0.3%, and 0.4% of a cyclic silazane, reference for example, U.S. Pat. No. 5,989,768, were used in place of the 0.4% aminopropyltriethoxysilane to incorporate the functional grouping methylaminopropylsilane of the formual $\equiv Si—(CH_2)_3—NHCH_3$, into and on the surface coating.

EXAMPLE VI

Procedures similar to Examples I and II were carried out except that an untreated hydrophilic $SiO_2$ having a silica primary particle size of 12 nanometers and an aggregate size of about 225 nanometers was used. In place of decyltrimethoxysilane and aminopropyltriethoxysilane compounds, a silane, such as poly (dimethylsiloxaneaminoethylaminopropyldimethylsilane) commercially available from Wacker Corp, was used that incorporated the functional group aminoethylaminopropylsilane of the formual $\equiv Si(CH_2)_3NH(CH_2)_2NH_2$ into and on the surface coating.

EXAMPLE VII

Surface Titration Procedure

The coated silicas prepared in Examples I, II, III-A, III-B, III-C, III-D, III-E, III-F, III-G, IV-A, IV-B, IV-C, IV-D, IV-E, V-A, V-B, V-C, V-D, and VI were surface titrated with HCl to determine the amount of basic nitrogen (N:) on the surface of the coated silica. The general procedure used follows. Approximately one gram of the coated silica sample was vacuum dried at 50° C. and then weighed into a 50 mL plastic centrifuge tube. Using a Dosimat, first 15 mL of 0.01N HCl in methanol and then 20 mL of methanol was added to the tube. The tube was then placed on a box shaker and agitated for one hour followed by centrifugation at 3,500 rpm for 15 minutes. An aliquot of 20 mL of the centrifuged liquid was placed in a 150 mL plastic beaker, 80 mL of deionized water was added and the sample titrated with 0.005N NaOH in methanol to determine the amount of unreacted HCl. The difference between the total HCl added and unreacted HCl is the amount of HCl that reacted with the basic nitrogen (N:) present on the surface of the coated silica. The amount of HCl reacted with the basic nitrogen (N:) on the surface of the coated silica is expressed in microequivalents of HCl absorbed per gram of sample. The microequivalents of HCl absorbed per gram of sample is equal to the microequivalents of basic nitrogen (N:) per gram of silica on the surface of the coated silica (microequivalents/gram). Multiplying the microequivalents of basic nitrogen (N:) on the surface of the coated silica by 14 converts the microequivalents to parts per million (ppm) of basic nitrogen (N:) on the surface of the coated silica. A control sample of coated silica containing no basic nitrogen (N:) on the surface of the coated silica was also titrated as above, and the results are subtracted from the samples containing basic nitrogen (N:) on the surface of the coated silica. This was done to correct for any HCl that may be adsorbed by the coated silica sample, and is therefore not due to reaction of the HCl with the basic nitrogen.

EXAMPLE VIII

Selected samples of the coated silica samples prepared in Examples I through VI yielded the following results upon titrating with HCl according to Example VII. The samples were also evaluated for triboelectric and admix performance. Samples with basic nitrogen less than about 400 ppm showed acceptable triboelectric and admix performance while samples with basic nitrogen greater than about 400 ppm showed unacceptable triboelectric and admix performance.

TABLE 1

| Example # | Silica Coating (basic nitrogen function) | micro-equiv-alents/ gram of silica | ppm (basic nitrogen func-tion) | Tribo and Admix Perform-ance |
|---|---|---|---|---|
| IV-A | Dimethylaminopropylsilane | 27 | 378 | + |
| V-B | Silazane | 7 | 98 | + |
| I | Aminopropylsilane | 25 | 350 | + |
| III-C | Aminopropylsilane | 28 | 392 | + |
| IV-D | Dimethylaminopropylsilane | 37 | 518 | UA |
| IV-E | Dimethylaminopropylsilane | 42 | 588 | UA |
| III-D | Aminopropylsilane | 52 | 728 | UA |
| III-E | Aminopropylsilane | 160 | 2240 | UA |
| III-F | Aminopropylsilane | 252 | 3528 | UA |
| VI | $-Si(CH_2)_3NH(CH_2)_2NH_2$ | 561 | 7854 | UA |
| VI | $-Si(CH_2)_3NH(CH_2)_2NH_2$ and a 2nd silica free of N: functionality | 26.7 | 374 | + |

Key:
+ = Acceptable;
UA = Unacceptable or Not Acceptable

EXAMPLE IX

Toner Resin Preparation

A toner resin was prepared by a polycondensation reaction of bisphenol A and fumaric acid to form a linear polyester referred to as RESAPOL HT, commercially available from Resena(Brazil).

A second polyester was prepared by selecting Resapol HT and adding to it in an extruder a sufficient amount of benzoyl peroxide to form a crosslinked polyester with a high gel concentration of about 30 weight percent gel, reference U.S. Pat. Nos. 5,376,494; 5,395,723; 5,401,602; 5,352,556, and 5,227,460, and more specifically, the polyester of the '494 patent, the disclosures of each of these patents being totally incorporated herein by reference.

EXAMPLE X

Toner Formulation 75 parts by weight of the resin Resapol HT from Example IX, 14 parts by weight of the 30 weight percent gel polyester from Example IX, and, 11.0 parts by weight of Sun Blue Flush, which is a mixture of 30 weight percent P.B. 15:3 copper phthalocyanine and 70 weight percent Resapol HT prepared at Sun Chemicals by flushing to obtain a high quality pigment dispersion, were blended together and extruded in a ZSK-40 extruder. The extruded blend was then jetted and classified to form a cyan toner containing 96.7 weight percent of resin and about 3.3 weight percent of P.B.15:3 pigment, and with a toner particle size of about 6.5 microns as measured in a Layson Cell. The final cyan toner had a gel concentration of 5 weight percent.

Comparative Example XI

A thirty gram sample of toner from Example X was added to a 9 ounce jar with 150 grams of stainless steel beads. To this was added 0.6 weight percent TS530, which is a 15 nanometer primary particle size fumed silica coated with hexamethyldisilazane from Cab-O-Sil Division of Cabot Corp., 0.9 weight percent TD3103, which is a 15 nanometer primary particle size titanium dioxide coated with decylsilane generated from decyltrimethoxysilane available from Tayca Corp., and 0.3 weight percent zinc stearate L from Synthetic Products Company. After blending on a roll mill for 30 minutes the steel beads were removed from the jar.

A developer was prepared by mixing 4 parts of the foregoing blended toner with 100 parts of a carrier of a Hoeganaes steel core which core is previously coated with 80 weight percent of polymethylmethacrylate and 20 weight percent of a conductive carbon black. Testing of this developer in an imaging fixture similar to the Xerox Model 5090® resulted in poor image quality primarily because of a loss in developability of the toner caused by, for example, the small size 15 nanometer TS530 silica, small size 15 nanometers of the TD3103 titanium dioxide, and the absence of a critical concentration of basic nitrogen (N:) incorporated in the coatings on the silica.

EXAMPLE XII

A toner blend was prepared as in Example XI except the TS530 was replaced with 3.2 weight percent of a fumed silica coated with a feed mixture of 16 weight percent decyltrimethoxysilane and 0.4 weight percent aminopropyltriethoxysilane to incorporate about 350 ppm of basic nitrogen onto the surface of the coated silica, see Example I in Table I. The silica had a 30 nanometer primary particle size and about a 325 nanometer aggregate size. The coating weight of this dual coated silica was about 7 weight percent. The TD 3103 in Example XI is replaced with 2.5 weight percent of MT5103, which is a 30 nanometers primary particle size titanium dioxide coated with decylsilane obtained from Tayca Corp. The dual coated basic nitrogen silica, MT3103, and 0.3 weight percent zinc stearate L from Synthetic Products Company, were blended onto the toner surface. After mixing on a roll mill for 30 minutes, the steel beads were removed from the jar. A developer was prepared by mixing 4 parts of the above blended toner with 100 parts of a carrier of Hoeganaes steel core coated with polymethylmethacrylate and 20 weight percent of a conductive carbon black. A 90 minute paint shake time track was completed for this developer with a resulting toner tribo at the end of 90 minutes equal to −20 microcoulombs/gram. During the 90 minute time track, toner tribo was stable and did not decrease with increasing time. Admix was accomplished at the end of the 90 minutes, resulting in a unimodal charge distribution at 15 seconds. Unlike the developer in Example XI, the charge distribution of the incumbent and incoming toner in this Example remained unimodal with no low charge (<0.2 femtocoulombs/micron ) or wrong sign positive toner throughout an additional 2 minutes of total paint shaking. In addition the q/d (femtocoulombs/micron, where q is the toner charge and d is the toner diameter) remained significantly greater than zero with no low charge or wrong sign toner forming. This developer enabled excellent copy quality images having excellent image density and low acceptable background.

EXAMPLE XIII

A toner blend was prepared as in Example XII except the 3.3 percent P.B.15:3 pigment was replaced with 5 weight percent Regal 330 carbon black, and the coated silica was replaced with 5.0 weight percent of a 30 nanometer primary particle size and about 325 nanometer aggregate size fumed silica coated with a feed mixture of 16 weight percent decyltrimethoxysilane and 0.2 weight percent methylaminopropyldimethyl silazane compound to incorporate 98 ppm of basic nitrogen onto the surface of the silica coating, see Example V-B in Table I. The coating weight of this dual coated silica was 6.8%. The TDD3103 was replaced with 1.5 weight percent of MT5103 which is a 30 nanometer primary particle size titanium dioxide coated with decylsilane obtained from Tayca Corp. The dual coated basic nitrogen silica, MT3103, and 0.5 weight percent zinc stearate L from Synthetic Products Company, were blended onto the toner surface. After mixing on a roll mill for 30 minutes the steel beads were removed from the jar. A developer was prepared by mixing 4 parts of the above blended toner with 100 parts of a carrier of Hoeganaes steel core coated with polymethylmethacrylate. A 90 minute paint shake time track was completed for this developer with a resulting toner tribo at the end of 90 minutes equal to −41 microcoulombs/gram. During the 90 minute time track, toner tribo was stable and did not decrease with increasing time. Admix was accomplished at the end of the 90 minutes, resulting in a unimodal charge distribution at 15 seconds. Unlike the developer in Example XI, the charge distribution of the incumbent and incoming toner in this Example remained unimodal with no low charge (<0.2 femtocoulombs/micron) or wrong sign positive toner throughout an additional 2 minutes of total paint shaking. In addition the q/d remained significantly greater than zero with no low charge or wrong sign toner forming. This developer enabled excellent copy quality images having excellent image density and low acceptable background.

EXAMPLE XIV

A toner blend was prepared as in Example XII except the coated silica was replaced with 3.2 weight percent of a 30 nanometer primary particle size and about 325 nanometer aggregate size fumed silica coated with a feed mixture of 16 weight percent decyltrimethoxysilane and a dimethylaminopropylsilane to incorporate 378 ppm of basic nitrogen onto the surface of the silica coating, see Example IV-A in Table I. The coating weight of this dual coated silica was 6.9 percent. The TDD3103 was replaced with 2.5 weight percent of MT5103 which is a 30 nanometer primary particle size titanium dioxide coated with decylsilane obtained from Tayca Corp. The dual coated basic nitrogen silica, MT3103, and 0.3 weight percent zinc stearate L from Synthetic Products Company, were blended onto the toner surface. After mixing on a roll mill for 30 minutes the steel beads were removed from the jar. A developer was prepared by mixing 4 parts of the above blended toner with 100 parts of a carrier of Hoeganaes steel core coated with polymethylmethacrylate and 20 weight percent of a conductive carbon black. A 90 minute paint shake time track was completed for this developer with a resulting toner tribo at the end of 90 minutes equal to −34 microcoulombs/gram. During the 90 minute time track the toner tribo was stable and did not decrease with increasing time. Admix was accomplished at the end of the 90 minutes resulting in a unimodal charge distribution at 15 seconds. Unlike the developer in Example XI the charge distribution of the incumbent and incoming toner in this Example remained unimodal with no low charge (<0.2 femtocoulombs/micron) or wrong sign positive toner throughout an additional 2 minutes of total paint shaking. In addition the q/d remained significantly greater than zero with no low charge or wrong sign toner forming. This developer enabled excellent copy quality images having excellent image density and low acceptable background.

Comparative Example XV

A toner blend was prepared as in Example XII except the coated silica was replaced with 3.2 weight percent of a 30 nanometer primary particle size and about 325 nanometer aggregate size fumed silica coated with a feed mixture of 16 weight percent decyltrimethoxysilane and an aminosilane (aminopropylsilane) to incorporate 2,240 ppm of basic nitrogen onto the surface of the silica coating, see Example III-E in Table I. The coating weight of this dual coated silica was 7 weight percent. The TDD3103 was replaced with 2.5 weight percent of MT5103, which is a 30 nanometer primary particle size titanium dioxide coated with decylsilane obtained from Tayca Corp. The dual coated basic nitrogen silica, MT3103, and 0.3 weight percent zinc stearate L from Synthetic Products Company were blended onto the toner surface. After mixing on a roll mill for 30 minutes the steel beads were removed from the jar. A developer was prepared by mixing 4 parts of the above blended toner with 100 parts of a carrier of Hoeganaes steel core coated with polymethylmethacrylate and 20 weight percent of a conductive carbon black. A 90 minute paint shake time track was completed for this developer which produced an unacceptable low toner tribo at the end of 90 minutes equal to −9 microcoulombs/gram. Admix was done at the end of the 90 minutes and provided a bimodal charge distribution at 15 seconds. The charge distribution of the incumbent and incoming toner in this Example remained bimodal with significant amounts of low charge (<0.2 femtocoulombs/micron) and wrong sign positive toner throughout an additional 2 minutes of total paint shaking. This developer resulted in poor copy quality images and high background.

Comparative Example XVI

A toner blend was prepared as in Example XII except the coated silica was replaced with 3.2 weight percent of a 30 nanometer primary particle size and about 325 nanometer aggregate size fumed silica coated with a feed mixture of 16 weight percent decyltrimethoxysilane and a dimethylaminopropylsilane to incorporate 588 ppm of basic nitrogen onto the surface of the silica coating, see Example IV-E in Table I. The coating weight of this dual coated silica was 7 percent. The TDD3103 was replaced with 2.5 weight percent of MT5103, a 30 nanometer primary particle size titanium dioxide coated with decylsilane obtained from Tayca Corp. The dual coated basic nitrogen silica, MT3103, and 0.3 weight percent zinc stearate L from Synthetic Products Company, were blended onto the toner surface. After mixing on a roll mill for 30 minutes the steel beads were removed from the jar. A developer was prepared by mixing 4 parts of the above blended toner with 100 parts of a carrier of Hoeganaes steel core coated with polymethylmethacrylate and 20 weight percent of a conductive carbon black. A 90 minute paint shake time track was completed for this developer with a resulting toner tribo at the end of 90 minutes equal to −19 microcoulombs/gram. Admix was done at the end of the 90 minutes providing a bimodal charge distribution at 15 seconds. The charge distribution of the incumbent and incoming toner in this Example remained bimodal with significant amounts of low charge (<0.2 femtocoulombs/micron) and wrong sign positive toner throughout an additional 2 minutes of total paint shaking. This developer resulted in poor copy quality images and high background.

EXAMPLE XVII

A toner blend was prepared as in Example XII except the coated silica was replaced with a mixture of two silicas. The first silica was 4.0 weight percent of a 30 nanometers primary particle size and about 325 nanometer aggregate size fumed silica coated with a feed of 15 weight percent decyltrimethoxysilane to produce a decylsilane coating. The coating weight of this coated silica was 6.8 percent. The second silica was 0.2 weight percent of a 12 nanometer primary particle size and about 225 nanometer aggregate size fumed silica in which the coating contained the function—Si(CH2)3NH(CH2)2NH2. Note that this silica contains 7,854 ppm basic nitrogen. The mixing of these two silicas together incorporated 374 ppm of basic nitrogen onto the surface of the two silicas, see Example VI in Table I. These two silicas, and 2.3 weight percent of MT5103 which is a 30 nanometer primary particle size titanium dioxide coated with decylsilane obtained from Tayca Corp., and 0.5 weight percent zinc stearate L from Synthetic Products Company, were blended onto the toner surface. After mixing on a roll mill for 30 minutes the steel beads were removed from the jar. A developer was prepared by mixing 4 parts of the above blended toner with 100 parts of a carrier of Hoeganaes steel core coated with polymethylmethacrylate. A 90 minute paint shake time track was completed for this developer with a resulting toner tribo at the end of 90 minutes equal to −44 microcoulombs/gram. During the 90 minute time track the toner tribo was stable and did not decrease with increased time. Admix was accomplished at the end of the 90 minutes resulting in a unimodal charge distribution at 15 seconds. Unlike the developer in Example XI, the charge distribution of the incumbent and incoming toner in this Example remained unimodal with no low charge (<0.2 femtocoulombs/micron) or wrong sign positive toner throughout an additional 2 minutes of total paint shaking. In addition the q/d remained significantly greater than zero with no low charge or wrong sign toner forming. This developer enabled excellent copy quality images having excellent image density and low acceptable background.

EXAMPLE XVIII

Blended Toners-Developers Containing a Decyltrimethoxysilane and Aminopropylsilane Treated Titania and a Decylsilane Treated Silica Surface Additives A toner blend is prepared as in Example XI except the TS530 is replaced with 3.2 weight percent of a 30 nanometers primary particle size and about 325 nanometers aggregate size fumed silica coated with 16 weight percent decyltrimethoxysilane to produce a decylsilane coating. The coating weight of this coated silica is about 7 weight percent. The TD 3103 in Example XI is replaced with 2.5 weight percent of a TiO2 (titania) with a 30 nanometer primary particle size which has been coated with about 8 weight percent feed decyltrimethoxysilane and an aminopropylsilane to incorporate 350 ppm of basic nitrogen onto the surface of the titania coating. The dual coated basic nitrogen titania, the decylsilane coated silica, and 0.3 weight percent zinc stearate L, available from Synthetic Products Company, were blended onto the toner surface. After mixing on a roll mill for 30 minutes, the steel beads were removed from the jar. A developer is prepared by mixing 4 parts of the above blended toner with 100 parts of a carrier of Hoeganaes steel core coated with polymethylmethacrylate and 20 weight percent of a conductive carbon black. A 90 minute paint shake time track is completed for this developer with a resulting toner tribo at the end of 90 minutes equal to about, for example, −20 microcoulombs/gram. During the 90 minute time track, toner tribo is stable and is not expected to decrease with increasing time. An admix measurement is accomplished at the end of the 90 minutes and provides a unimodal charge distribution at 15 seconds. Unlike the developer in Example XI, the charge distribution of the incumbent(resident) and incoming(fresh) toner in this Example remains unimodal with no low charge (<0.2 femtocoulombs/micron) or wrong sign positive toner throughout an additional 2 minutes of total paint shaking. In addition the q/d (femtocoulombs/micron), where q is the toner charge and d is the toner diameter, remains significantly greater than zero with no low charge or wrong sign toner forming. This developer enables excellent copy quality images with excellent image density and low acceptable background.

Other modifications of the present invention may occur to one of ordinary skill in the art subsequent to a review of the present application, and these modifications, including equivalents thereof, are intended to be included within the scope of the present invention.

What is claimed is:

1. A toner composition comprised of binder, colorant, and a toner particle surface additive component comprised of a first coated fumed silica surface coated with a first major amount of an alkylsilane compound present in an amount of from about 3 to about 20 weight percent based on the weight of the fumed silica and a second minor amount of an aminoalkylsilane compound present in an amount of from about 3 to about 700 parts per million of basic nitrogen (N:) based on the weight of the fumed silica.

2. A toner in accordance with claim 1 wherein the first fumed silica has with a primary particle size diameter determined by BET measurement of from about 25 to about 75 nanometers and an aggregate particle size of from about 225 nanometers to about 400 nanometers.

3. A toner in accordance with claim 1, wherein the minor amount of the aminoalkylsilane compound is present on the fumed silica in an amount of from about 0.01 to about 1.0 weight percent based on the weight of the fumed silica.

4. A toner in accordance with claim 1, wherein the alkyl group of the alkylsilane coating compound contains from 3 to about 20 carbon atoms.

5. A toner in accordance with claim 1, wherein the alkylsilane coating compound is obtained from a decyltrialkoxysilane compound.

6. A toner in accordance with claim 1, wherein the aminoalkylsilane coating compound contains an alkyl group with from 2 to about 10 carbon atoms between the silicon atom and the nitrogen atom.

7. A toner in accordance with claim 1, wherein the aminoalkylsilane coating compound is obtained from a dialkylaminopropyltrialkoxysilane compound.

8. A toner in accordance with claim 1, wherein the aminoalkylsilane coating compound is obtained from a γ-aminopropyltrialkyloxysilane compound.

9. A toner in accordance with claim 1, wherein the aminoalkylsilane is a diaminoalkylsilane compound which contains a substituent of at least the formula $NH_2CH_2CH_2NHCH_2CH_2CH_2Si—O—$.

10. A toner in accordance with claim 1, wherein the aminoalkylsilane compound is a cyclic silazane which contains a substituent of at least the formula $CH_3NHCH_2CH_2CH_2Si(CH_3)—O—$ and wherein the substituent is incorporated into the silica coating.

11. A toner in accordance with claim 1, wherein the coated silica is present in the toner composition in an amount of from about 1 to about 8 weight percent.

12. A toner in accordance with claim 1, wherein the resin is a styrene acrylate copolymer, a styrene methacrylate copolymer, styrene butylacrylate copolymer, a polyester, or mixtures thereof.

13. A toner in accordance with claim 1, wherein the toner composition has a cohesivity of about 4 to about 40 percent, a stable triboelectrical charge of from about 10 to about 50 microcoulombs per gram, a q/d of from about 0.2 to about 1.1 femtocoulombs per micron, and an admix time of from about 1 to about 29 seconds.

14. A developer comprising a polymer coated carrier and a toner in accordance with claim 1, wherein the toner has a unimodal charge distribution as measured by a charge spectrograph.

15. A developer comprising a polymer coated carrier and a toner in accordance with claim 1, wherein the toner has little or no low charge or wrong sign toner as measured by a charge spectrograph.

16. A developer comprising a polymer coated carrier and a toner in accordance with claim 1, wherein fresh toner when mixed with aged toner in a machine toner throughput mode has little or no low charge or wrong sign toner as measured by a charge spectrograph.

17. A toner in accordance with claim 1, further comprising minor amounts of toner charge additives, waxes, metal salts, or metal salts of fatty acids, and mixtures thereof.

18. A toner in accordance with claim 1, wherein the colorant is a pigment of cyan, magenta, yellow, black, red, green, blue, a dye, or mixtures thereof, and wherein the colorant is present in an amount of from about 2 to about 30 weight percent based on the weight of the toner composition.

19. A toner composition comprised of binder, colorant, and a toner particle surface additive component comprised of a mixture of first coated fumed silica present in the toner composition in an amount of from about 1 to about 8 weight percent which first silica is coated with an alkylsilane compound in an amount of from about 3 to about 20 weight percent based on the weight of the first coated fumed silica, and a second coated fumed silica present in the toner composition in an amount of from about 0.05 to about 5 weight percent which second silica is coated with an aminoalkylsilane compound in an amount of from about 1 to about 20 weight percent based on the weight of the second coated fumed silica, wherein the first and second fumed silicas each has a primary particle size diameter determined by BET measurement of from about 25 to about 75 nanometers and an aggregate particle size of from about 225 nanometers to about 400 nanometers.

20. A developer comprised of a polymer coated carrier and a toner in accordance with claim 19.

21. A developer in accordance with claim 20, wherein the polymer coated on the carrier is polymethylmethacrylate.

22. A developer in accordance with claim 20, wherein the coated carrier contains a mixture of polymers.

23. A toner composition comprised of binder, colorant, and a toner particle surface additive component comprised of a mixture of first coated fumed silica present in the toner composition in an amount of from about 1 to about 8 weight percent and which first silica is coated with an alkylsilane compound in an amount of from about 3 to about 20 weight percent based on the weight of the first coated fumed silica, and a second coated fumed silica present in the toner composition in an amount of from about 0.05 to about 5 weight percent and which second silica is coated with an aminoalkylsilane compound in an amount of from about 1 to about 10 weight percent based on the weight of the second coated fumed silica, wherein the first fumed silica has an uncoated primary particle size diameter determined by BET measurement of from about 25 to about 75 nanometers and an aggregate size diameter of about 225 to about 400 nanometers, and the second fumed silica has an uncoated primary particle size diameter determined by BET measurement of from about 8 to about 25 nanometers and an aggregate size diameter is about 200 to about 275 nanometers, and wherein the first and second coated fumed silicas are mixed together so that the total silica present in the toner composition has a surface nitrogen content in an amount of from 3 to about 700 parts per million of basic nitrogen (N:) based on the total weight of the two fumed silicas.

24. A toner in accordance with claim 23, wherein the first and second coated fumed silicas are mixed together so that the total silica present in the toner composition has a surface nitrogen content in an amount of from about 5 to about 500 parts per million of nitrogen based on the total weight of the two fumed silicas.

25. A developer comprised of a polymer coated carrier and a toner in accordance with claim 23.

26. A developer in accordance with claim 25, wherein the polymer coated on the carrier is polymethylmethacrylate.

27. A developer in accordance with claim 25, wherein the coated carrier contains a mixture of polymers.

28. An imaging process comprising the development of an electrostatic image with a toner of claim 1.

29. An imaging apparatus comprising a photoreceptor, a developer housing for developing latent images on the photoreceptor, a receiver member for receiving the developed latent image from the photoreceptor, and a fuser roll for fixing the developed image on the receiver member, wherein the fuser roll life is improved from about 100,000 prints to from about 500,000 prints compared to an imaging apparatus which develops a toner composition which is free of the fumed coated additive of claim 1.

30. An imaging apparatus comprising a photoreceptor, a developer housing for developing latent images on the photoreceptor, a receiver member for receiving the developed latent image from the photoreceptor, and a fuser roll for fixing the developed image on the receiver member, wherein the fuser roll life is improved from about 100,000 prints to from about 500,000 prints compared to an imaging apparatus which develops a toner composition which is free of the fumed coated additive of claim 19.

31. An imaging apparatus comprising a photoreceptor, a developer housing for developing latent images on the photoreceptor, a receiver member for receiving the developed latent image from the photoreceptor, and a fuser roll for fixing the developed image on the receiver member, wherein the fuser roll life is improved from about 100,000 prints to from about 500,000 prints compared to an imaging apparatus which develops a toner composition which is free of the fumed coated additive of claim 23.

32. A toner composition comprised of binder, colorant, and a toner particle surface additive component comprised of a coated metal oxide coated with a first major amount of an alkylsilane compound and a second minor amount of an aminoalkylsilane compound wherein the coated metal oxide has a surface nitrogen content in an amount of from 3 to about 700 parts per million of basic nitrogen (N:) based on the total weight of the coated metal oxide.

33. A toner composition in accordance with claim 32, further comprising a second toner particle surface additive component free of surface coating compounds.

34. A toner composition in accordance with claim 1, wherein the second minor amount of the aminoalkylsilane compound is present in an amount of from about 10 to about 400 parts per million of basic nitrogen (N:) based on the weight of the fumed silica.

35. A toner composition in accordance with claim 1, wherein the second minor amount of the aminoalkylsilane compound is present in an amount of from about 325 to about 375 parts per million of basic nitrogen (N:) based on the weight of the fumed silica.

* * * * *